US007622691B2

(12) United States Patent
De Greef

(10) Patent No.: US 7,622,691 B2
(45) Date of Patent: Nov. 24, 2009

(54) DEVICE FOR CLASSIFYING PRODUCTS

(75) Inventor: Jacob Hendrik De Greef, Waardenburg (NL)

(73) Assignee: De Greef's Wagen-, Carrosserie- en Machinebouw B.V., Tricht (NL)

( * ) Notice: Subject to any disclaimer, the term of this patent is extended or adjusted under 35 U.S.C. 154(b) by 624 days.

(21) Appl. No.: 10/499,582

(22) PCT Filed: Dec. 18, 2002

(86) PCT No.: PCT/NL02/00847

§ 371 (c)(1),
(2), (4) Date: Jan. 27, 2005

(87) PCT Pub. No.: WO03/051540

PCT Pub. Date: Jun. 26, 2003

(65) Prior Publication Data

US 2008/0169225 A1 Jul. 17, 2008

(30) Foreign Application Priority Data

Dec. 18, 2001 (NL) ..... 1019600

(51) Int. Cl.
*B07C 5/00* (2006.01)

(52) U.S. Cl. ..... 209/576; 209/588; 209/912; 209/921

(58) Field of Classification Search ..... 209/576, 209/588, 912, 921
See application file for complete search history.

(56) References Cited

U.S. PATENT DOCUMENTS

| | | | | |
|---|---|---|---|---|
| 3,930,994 | A | 1/1976 | Conway et al. | |
| 4,035,636 | A * | 7/1977 | Tengsater | 250/223 R |
| 4,585,126 | A | 4/1986 | Paddock et al. | |
| 2001/0032807 | A1 | 10/2001 | Powell | |
| 2003/0201209 | A1 * | 10/2003 | De Baerdemaeker et al. | 209/576 |
| 2005/0167613 | A1 * | 8/2005 | Bol et al. | 250/492.1 |

FOREIGN PATENT DOCUMENTS

| | | |
|---|---|---|
| FR | 1 011 349 | 6/1952 |
| FR | 2 710 564 | 4/1995 |
| FR | 2 726 651 | 5/1996 |
| WO | WO 00/013809 | 3/2000 |

* cited by examiner

*Primary Examiner*—Patrick H Mackey
*Assistant Examiner*—Terrell H Matthews
(74) *Attorney, Agent, or Firm*—James S. Keddie; Bret E. Field; Bozicevic, Field & Francis LLP

(57) ABSTRACT

Device for classifying products such as fruits, comprising: a number of product carriers for carrying the products in a transport path of a conveyor with classification outlets, radiating means for irradiating the products, one or more radiation receiving elements for receiving a radiation sample of radiation emitted by the radiating means once it has irradiated the product during transport of the products by the conveyor.

29 Claims, 9 Drawing Sheets

DEVICE FOR CLASSIFYING PRODUCTS

The present invention relates to the field of product sorting devices for sorting products such as vegetables and fruit and the like. Devices are known in this field which assign fruit to classes on the basis of a number of criteria. Fruits are herein singulated, whereafter singulated products are classified according to for instance weight, colour characteristic or size. A recent development in this field is that, in order to increase the value of a batch of fruit, classification is carried out in accordance with an increasing number of aspects, this preferably taking place at increasingly higher speeds.

Classifications which can increase particularly the added value relate to the interior of the fruit. Fruits with guaranteed characteristics in respect of sweetness, acidity, ripeness, the presence of rot or the amount of water in the product have a higher value than fruits where such characteristics are not known. Such characteristics can be determined using destructive testing methods, this being possible with random tests on a batch. The tested products hereby become unfit to eat more quickly, while the characteristics are only guaranteed for the tested products.

The present invention provides a device for classifying products such as fruits, comprising:

- a number of product carriers for carrying the products in a transport path of a conveyor with classification outlets,
- radiating means for irradiating the products,
- one or more radiation receiving elements for receiving a radiation sample of radiation emitted by the radiating means once it has irradiated the products during transport of the products by the conveyor.

In such a device it is possible to irradiate the products with radiation for the purpose of receiving components of the radiation which pass through the products. A frequency intensity diagram can be made of the radiation radiated through the fruit and received by the radiation receiving elements. Since different substances absorb different frequencies of this radiation, it can be inferred from the frequency intensity diagram whether much or little of particular substances is present in the product. It is hereby possible to determine for instance how much sugar or acid is present in a fruit. Other aspects which can be determined with this method are the amount of water, the presence of rot, such as core rot, or the ripeness.

The radiation receiving elements are preferably disposed movably for co-displacing with the product carrier during receiving of the radiation sample. Advantages of this embodiment are that, because the radiation receiving elements co-displace with the product carrier during receiving of the radiation sample, a receiving time of some duration can be achieved. It hereby becomes possible for instance to use a radiation source of lower power or to obtain a light sample of a higher quality. An advantage of the radiation conducting means lies in the fact that robust and simple radiation receiving elements, which are disposed movably in order to obtain the above stated high quality radiation sample, can be connected to more costly radiation measuring means which are preferably arranged in stable and stationary manner. A glass fibre cable can herein serve as radiation conducting means.

The radiation receiving elements are preferably arranged for reciprocating movement for the purpose of co-displacement with the product carrier during receiving of a radiation sample and the return movement between the receiving of successive samples. Such an arrangement has the further advantage that, with for instance a small number of radiation receiving elements, such as 1, 2 or 3, it is therefore also possible herein to suffice with a small number of radiation measuring means.

In a further preferred embodiment the radiation receiving elements are driven by a linear motor. With a very simple construction, such a motor allows radiation receiving elements to run at substantially the same speed as the fruit carrier and at a uniform speed during receiving of a light sample, and also allows the radiation receiving elements to be moved back at high speed, between receiving of the light samples, to a starting position for receiving the radiation sample so as to enable receiving of a radiation sample to begin in good time at the position of a following fruit carrier.

In another embodiment the radiation receiving elements are driven by a rotation motor which is connected thereto by means of a crankshaft and drive rod construction. Such a construction has the advantage that a rotation motor can be applied with a relatively constant rotation speed.

A further embodiment comprises a measuring conveyor on which a number of radiation receiving elements are mounted and the speed of which is adjustable to substantially the same speed as that of the conveyor. This embodiment has the advantage that the receiving elements have a constant forward speed while measurements are performed.

A further embodiment according to the present invention comprises radiation measuring means for carrying out measurements on the radiation sample received by the radiation receiving elements. An advantage of this embodiment is that the radiation measuring means can be placed at a distance from the radiation receiving elements.

A further embodiment provides analysis means for analysing the radiation sample. The products are grouped into classes on the basis of the analysis and by the analysis means.

In a preferred embodiment according to the present invention the radiation has a wavelength range of 300 to 2500 nanometers. A very large amount of information about the composition of the fruit can be derived with this very wide spectrum.

A further preferred embodiment according to the present invention comprises radiation conducting means for conducting the light received by the radiation receiving elements to the radiation measuring means.

In a further preferred embodiment the illuminating means are arranged substantially above the transport path of the product carriers. Such a setup makes it possible to apply a plurality of tracks of product carriers closely adjacent to each other. An advantage hereof is that the number of fruits for classifying is high and that the classifying device according to the present invention can be applied in prior art sorting devices.

A further preferred embodiment provides illuminating means arranged substantially adjacently of the transport path of the product carriers. In the case product carriers of the gripper type are used, it may be desirable to arrange illuminating means along such a transport path, or optionally under the transport path.

In a further preferred embodiment the product carrier is a cup on which the product is placed, wherein it is provided with an opening on the underside for passage of the radiation from the irradiating means which irradiates through the product. An annular body of soft material can further be arranged around the opening for supporting at least relatively small products. A product supporting part of the cup has a surface curvature for supporting the products such that relatively small products are supported closer to the edge of the opening and relatively large products are supported further from the edge of the opening so as to position the underside of both large products and small products against an edge of the hole. If the cup has a lowered side for receiving and/or placing products using gripper means, the products can be placed very simply and at high speed in these cups which are suitable for the performing of irradiation measurements. The embodiments with these features can therefore perform such radiation measurements at speeds which are desired in fruit sorting devices, such as for instance 6 to 9 fruits per second or even 9 to 14 fruits per second. Embodiments with the above described features are even able to perform such measurements with a plurality of conveyor belts placed directly adjacent of each other. A centre-to-centre distance between successive product carriers is also possible of 100-200 mm, preferably 100-150 mm, in particular preference between 100 and 140 mm. It is further possible to arrange the tracks adjacently of each other with a track width of for instance 140 to 290 mm. In the other preferred embodiment a light measurement is performed in a product carrier comprising gripper elements which pick up the fruits from two sides. Such gripper elements can be equipped with a hole for the passage of light from the illuminating means which radiates through the product. Such gripper elements can be equipped with an opening for the passage of the light from the illuminating means for irradiating the products such that a light receiving element on the other side of the fruit can receive a light sample.

In a further preferred embodiment according to the present invention the product carrier comprises two diabolo-shaped elements. Such diabolo-shaped elements are suitable for carrying a product and are known for transporting products. The diabolo-shaped body herein preferably comprises two halves, between which there is a free space. This makes it possible to place a light receiving element under an advancing row of diabolos in similar manner as such a light receiving element is placed under an advancing row of cups. Using the light receiving element, light samples can then be taken of the product which is irradiated from above. An advantage of such an embodiment is that products already situated on such a diabolo conveyor can be immediately subjected to a light measuring operation.

A preferred embodiment according to the present invention comprises two or more receiving elements for simultaneously receiving light samples from a plurality of product carriers. Since according to the present invention the receiving elements must co-displace with the product carriers for a period of time and the product carriers move forward at constant speed, it is necessary that the receiving elements move forward with the uniform speed of movement of the conveyors during the light measurement, and are then moved back at high speed to a starting position for a subsequent measurement. If a number of receiving elements are fixed to each other with the centre-to-centre distance of successive fruit carriers on the conveyor as intermediate spacing, they can perform a number of measurements simultaneously and the return movement of the receiving elements for a subsequent measurement can take place more slowly. Certainly if transport speeds of more than seven product carriers per second have to be realized, it is necessary to arrange a number of receiving elements simultaneously.

In a further embodiment radiation regulating elements are arranged on either side of the conveyor on either side of the radiation beam from the radiating means to the product carriers for the purpose of blocking radiation not directed at the product carrier. Such a radiation regulating element is preferably movable and/or manufactured from reflective material in order to reflect the radiation. Such reflective elements can increase the amount of light irradiated onto and through products.

A further preferred embodiment according to the present invention provides a product carrier for a conveyor having a downward narrowing contour as seen from above for holding a product in the middle, wherein the contour has three or more lines or surfaces for supporting the product. Such a product carrier preferably further comprises an opening in the middle of the contour. A further aspect of such a product carrier is a sheet which is provided with an opening wherein the distance between the opening and the opening of a following product carrier is roughly equal to the pitch distance of the conveyor. Advantages of such a product carrier are that a product seals the hole optimally, which is important for a radiation measurement. Differences in height of products placed in the product carrier are as small as possible. Particularly products of 40 to 100 mm diameter can be used optimally with such a carrier. Such product carriers applied in a device according to the present invention make a high speed possible as described above.

A further preferred embodiment according to the present invention provides a method for taking measurements on products while making use of a device as specified above, comprising the following steps of:

illuminating a product by the illuminating means, receiving a light sample by one or more receiving elements, performing one or more measurements on the light sample.

Further advantages, features and details of the present invention will be further described with reference to the annexed figures, in which:

FIG. 14 shows a cross-section of a further embodiment according to the present invention;

Figure 15B:
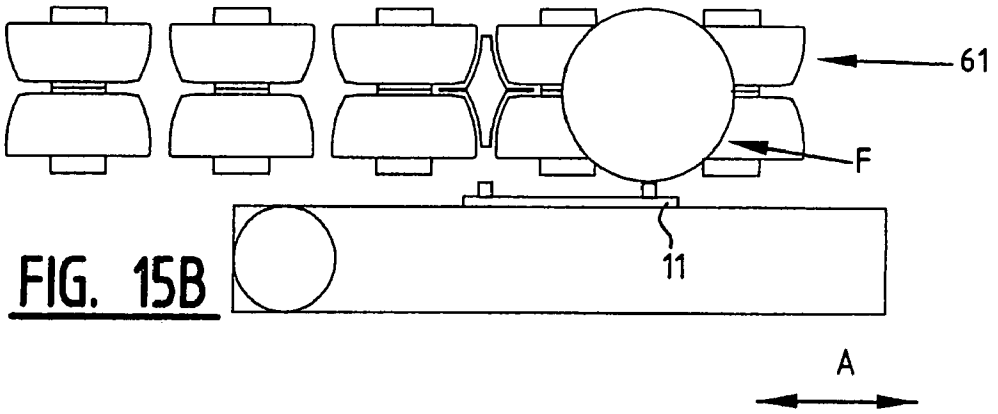
Figure 15A:
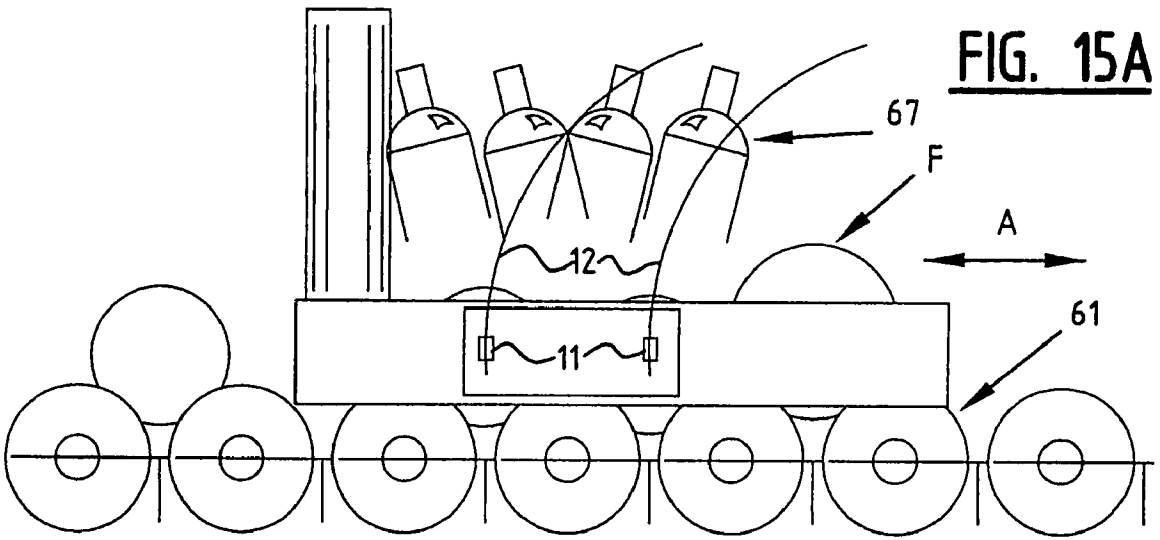
Figure 15C:
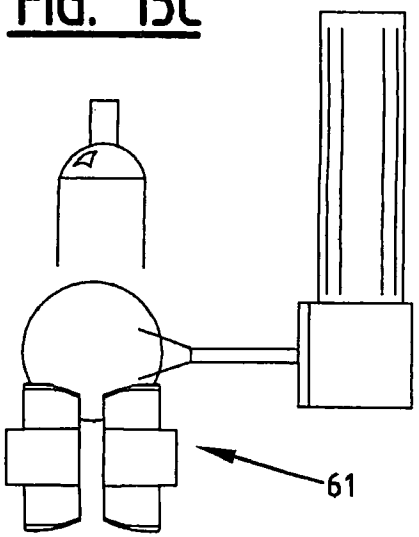

FIGS. 15A-C shows cross-sections in side, top and front view of a further embodiment according to the present invention.

A preferred embodiment according to the present invention (FIG. 1) is provided with a conveyor (not shown) on which fruit carriers 3 (cups) are arranged. These fruit carriers have a centre-to-centre spacing of 100 to 200 mm. Sheets 5 are preferably mounted on the rear side of the cups. In the fruit carriers are situated fruits F on which measurements are done. Illuminating elements 7 are arranged for this purpose above the array of fruit carriers. These illuminating elements 7 comprise mirrors 8, lamps 9 and lens systems 10 which are ordered such that the light of the lamps is reflected by the mirrors to the lenses mounted under the lamps. Situated below the conveyor are two light receivers 11 which transport received light via glass fibre cables 12 to light measuring means (not shown).

During operation the cups 3 are transported in the direction of arrow A by the conveyor. Fruits F are situated in the cups. These fruits are illuminated from above by means of light L from lamps 9. This light has a wide wavelength range of preferably 300 to 2500 nanometers. The lamps each produce for instance 250 W and the light is focussed on the fruits by means of the lenses. Some of the light will be absorbed by the fruit, while some of the light will be able to penetrate through the fruit. The light passing through the fruit is transmitted through a hole situated in the centre of the cup, and part of it will be collected by the light receivers 11. In order to obtain a good measurement, it is recommended that the light receivers are able to collect light for the measurement for a determined period of time of for instance 100 milliseconds. For this purpose the light receivers are transported forward at the same speed as a fruit carrier by linear motor 15 during illumination of the fruit, so that the light receivers are situated under the advancing cup and fruit during a measuring period. After this period the light receivers are moved back very rapidly so as to perform a similar measurement on two following fruits.

An alternative method for reciprocating movement of the light receivers is by means of a crankshaft and drive shaft construction, which has the advantage that the rotation direction of the drive motor does not have to be reversed for reciprocating movement of the light receivers. The angular acceleration can further be precisely controlled in this case. A further advantage is that, at fruit transport speeds in the conveyors of up to seven fruits per second, it is possible to suffice with one light receiver, which results in a saving on these costly components and in a simple construction.

In this embodiment the cups are provided with a sheet 5 over which the fruit can be carefully offloaded at a later stage and over which the fruit can roll out of the cup. In view of the length of sheet 5 which extends in use under the following cup, this sheet is provided at a suitable location 6 with a hole which is situated during use under the hole of the following cup. It is hereby possible that the sheet of a preceding cup transmits the light of a cup on which measurement must be made. The light receivers are situated under the cups. Arranged round the light receivers is a light-excluding housing with a small hole on the top for passage of light. The object of this housing is that the least possible spurious light, i.e. light not irradiated through the product, will form part of the light sample. For this purpose the cup is also manufactured from a dark material through which light cannot radiate, or only with difficulty. The hole on the underside of the cup can also be provided with an annular body of round, soft material which can also serve as light seal. Another object of such a ring is to form a soft bed for the products.

The illuminating means can be embodied as halogen lamps. Three lamps of 250 W can for instance be used per fruit carrier for illuminating.

Figures 1, 2:
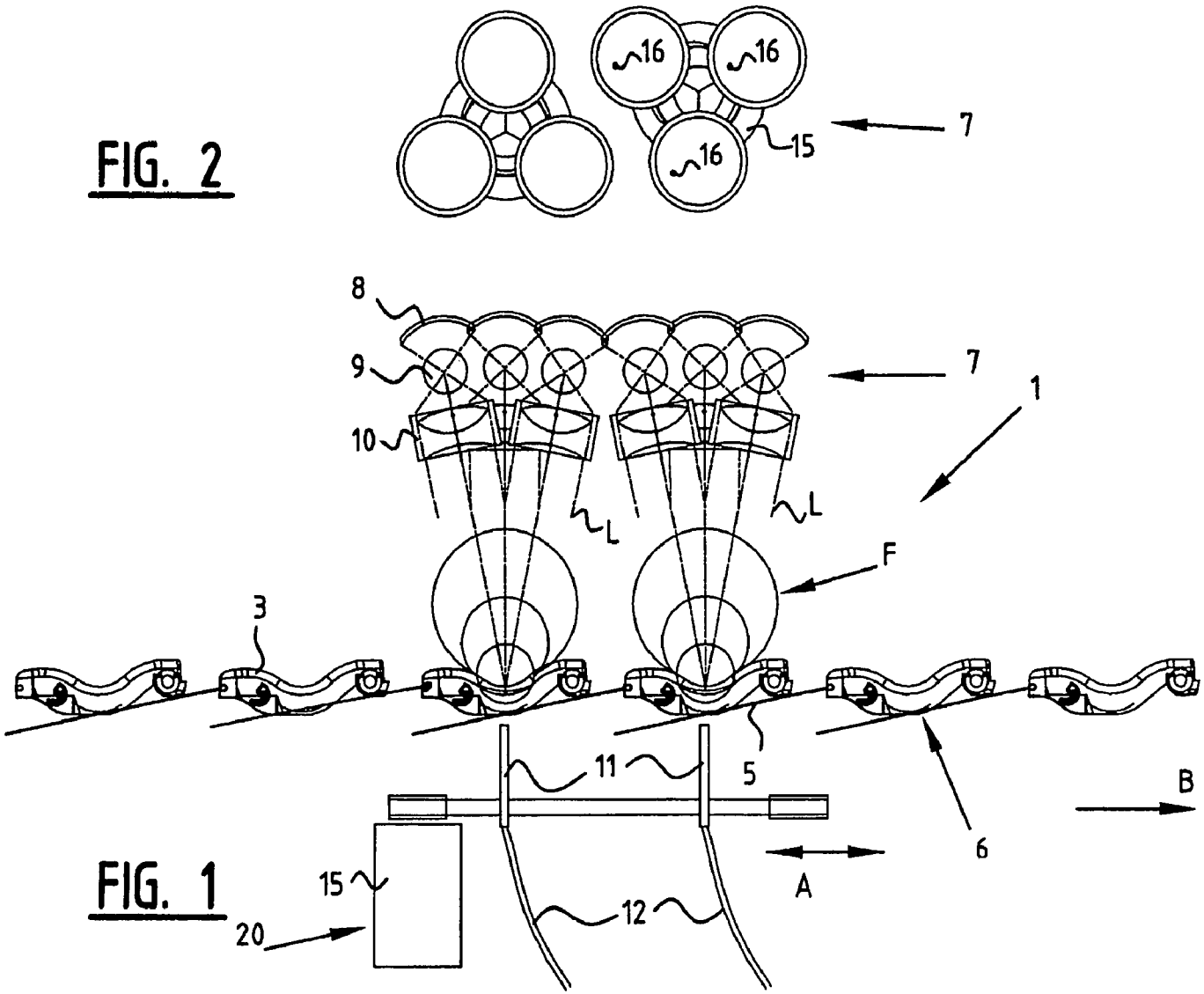
FIG. 1 shows a side view of a first embodiment according to the present invention.
FIG. 2 is a top view of a detail of the embodiment of FIG. 1.

FIG. 2 shows a top view of the illuminating means 7 of FIG. 1. Here can be seen that the three fittings 16 present per fruit for illuminating have a focussing area 15 on which the light is focussed. This manner of illumination allows a high light intensity per fruit for illuminating.

Figure 3:
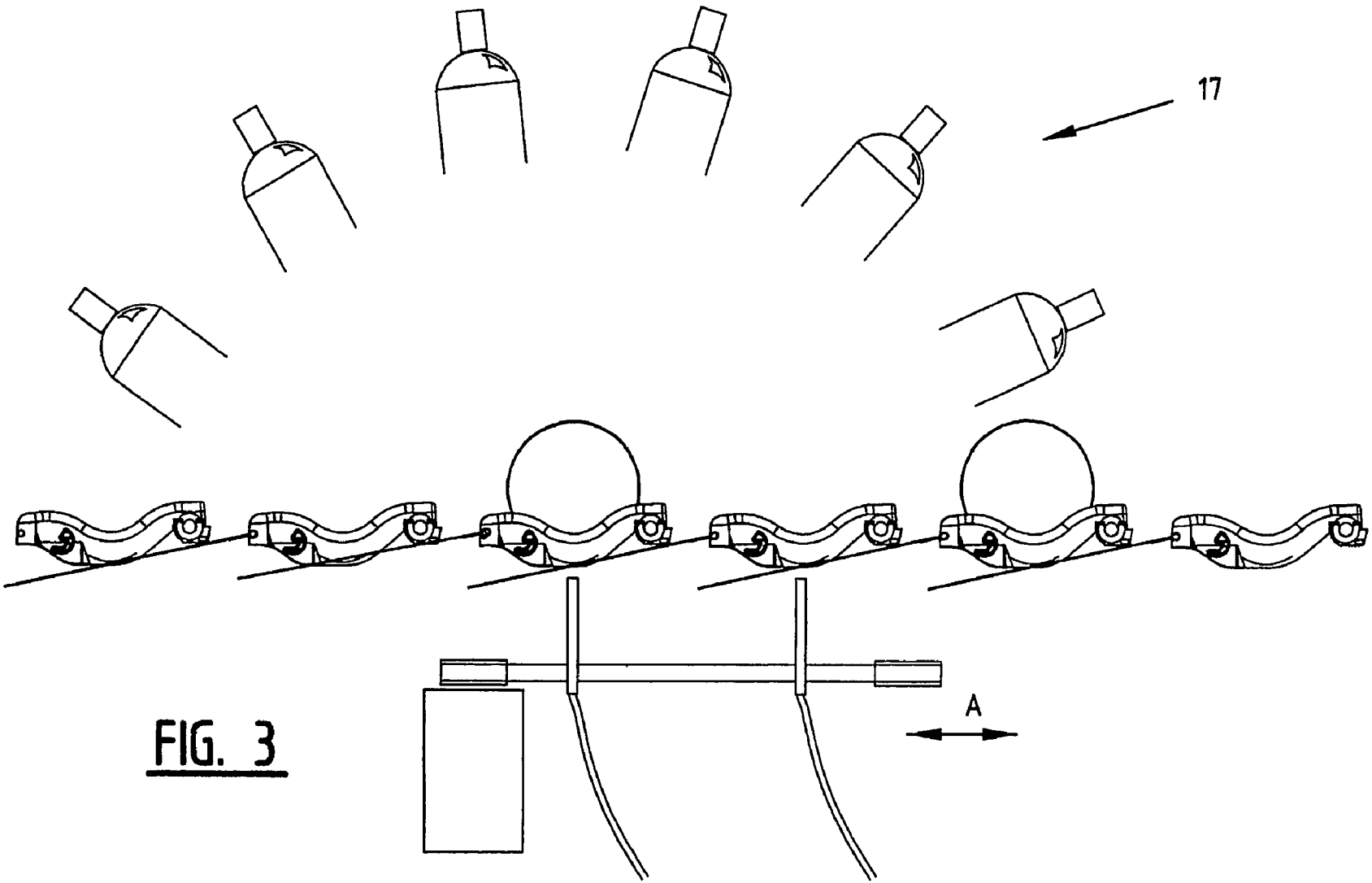
FIG. 3 is a side view of a further embodiment according to the present invention.

FIG. 3 shows a device similar to FIG. 1. The light measuring means 17 here take a different form, however. In this embodiment six lamps are positioned in an arc. Such an illuminating arc enables various measurement configurations, two of which will now be discussed.

A first measurement configuration is that all lamps shine with the same intensity and thus illuminate the fruit equally intensely from all sides. Such an illumination provides the light sample to be measured with information from the whole of the flesh of the fruit. If for instance a measurement of the sugar content of the whole flesh is important, such a measurement is recommended since information from the whole flesh will be included in the light sample. If however a measurement of a possible quantity of brown rot in the fruit is important, the two outer lamps can for instance be switched off, whereby the amount of information in the light sample will relate mainly to the middle of the fruit, whereby a relatively large amount of information about such brown rot will be included in the light sample. Such a measurement serves little purpose if for instance the fruit is provided with a large hard core or stone. In such cases a measurement and a light configuration directed at the outside of the fruit is of great importance. For further operation of this embodiment reference is made to the foregoing.

Figure 4:
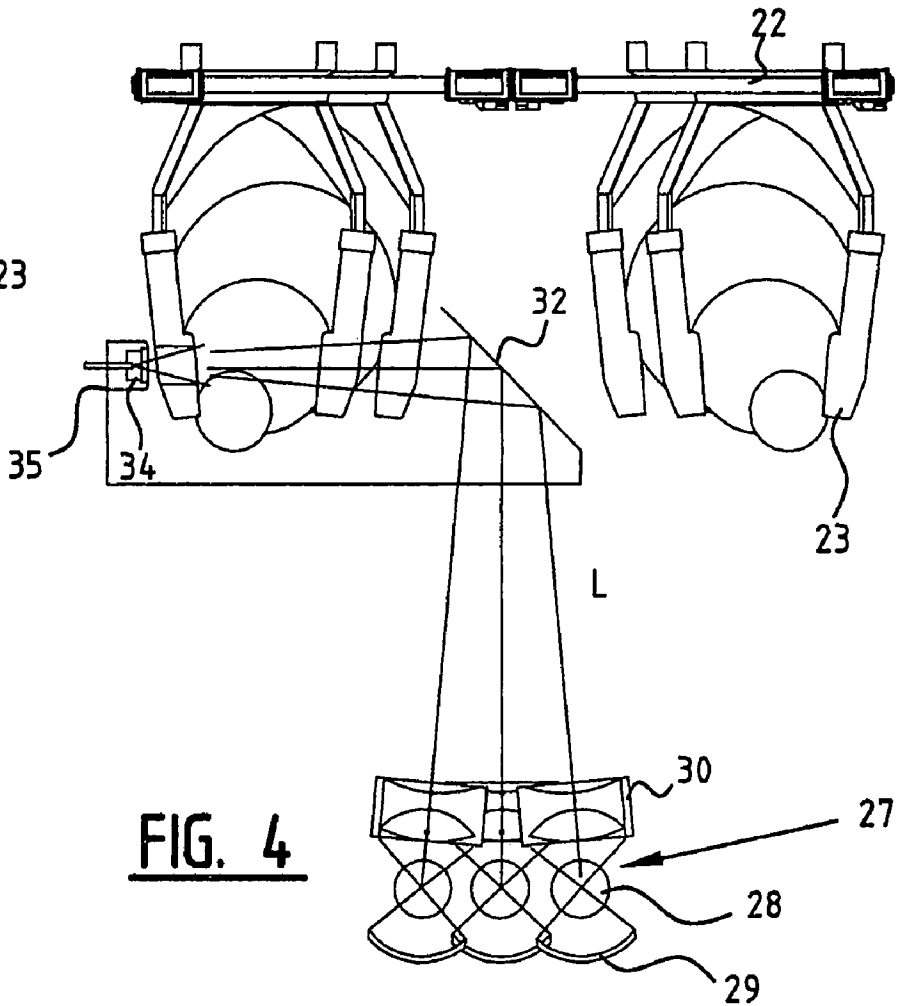
FIG. 4 is a front view of a further embodiment according to the present invention.
Figure 5:
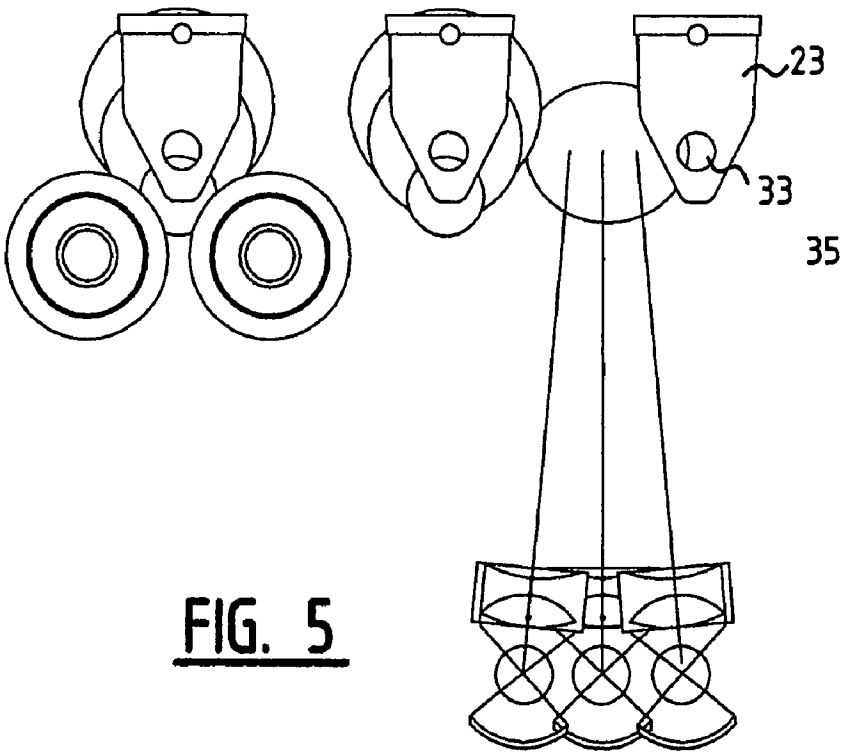
FIG. 5 is a side view of a further embodiment according to the present invention.

In a further embodiment (FIGS. 4 and 5) the fruit carrier is embodied as a pair of grippers 23, which are mounted suspended from opening and closing unit 22. This opening and closing unit 22 is fixed to a conveyor (not shown). Below the conveyor with grippers is situated illuminating unit 27. In similar manner as in the embodiment of FIG. 1, the light L from the lamps 28 is radiated toward the fruit either via mirrors 29 or via lens system 30. The light is deflected by means of mirror 32 in order to enable irradiation of the fruit. Grippers 23 are provided with openings 33 for the passage of light L. If the grippers are carrying a fruit, the light will be radiated through a part of the fruit and collected by light receiver 34 situated in a housing 35. With a similar purpose as in the embodiment of FIG. 1, the light receiver 34 will co-displace for a short period with the fruit in order to allow a light measurement for a determined period of time. For this purpose the illuminating unit 27 will also make a tilting movement so as to cause a focussed light beam to shine with the highest intensity for the same time period so that a maximum light output is available for the light reception.

Figure 6:
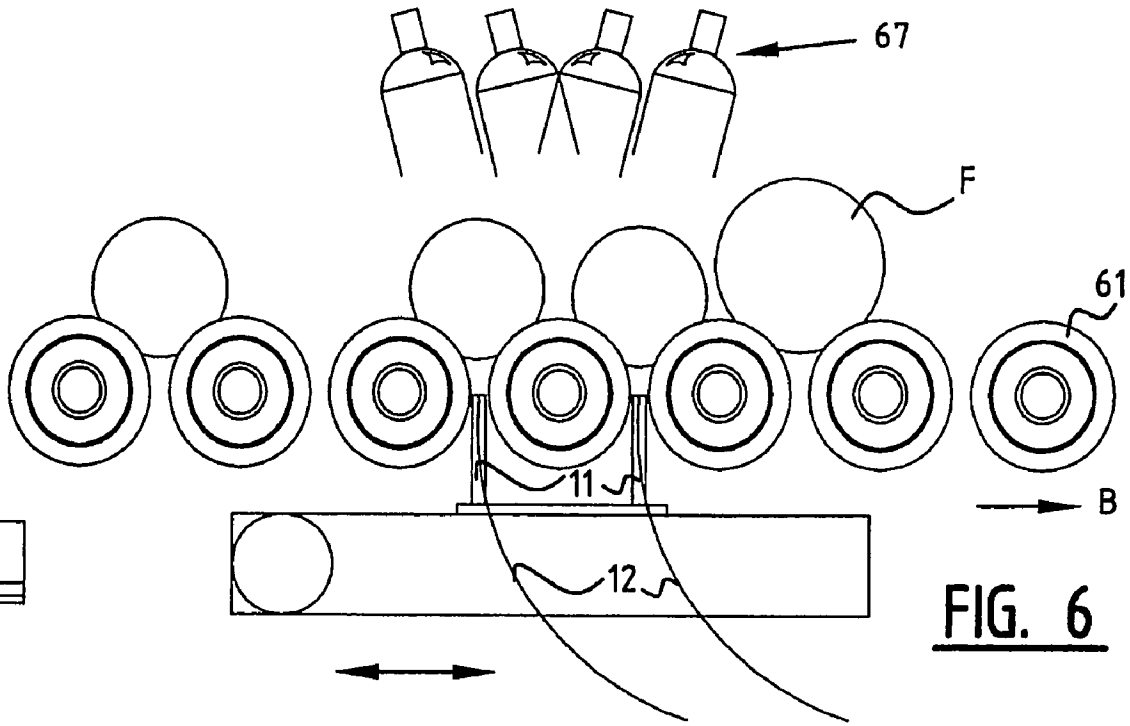
FIG. 6 is a side view of a further embodiment according to the present invention.

FIG. 6 shows another embodiment in which use is made of a diabolo 61. Each embodiment is provided with two light receivers 11 with two glass fibre cables for carrying the light samples to light measuring means (not shown). Fruits F are situated on the diabolos and are illuminated using the illuminating means 67. In this embodiment the light receiving means also co-displace for a short period of time with the fruits in order to obtain a high-quality light measurement. What is particularly important, however, is that the intensity over the measuring area is as uniform as possible.

Figure 7:
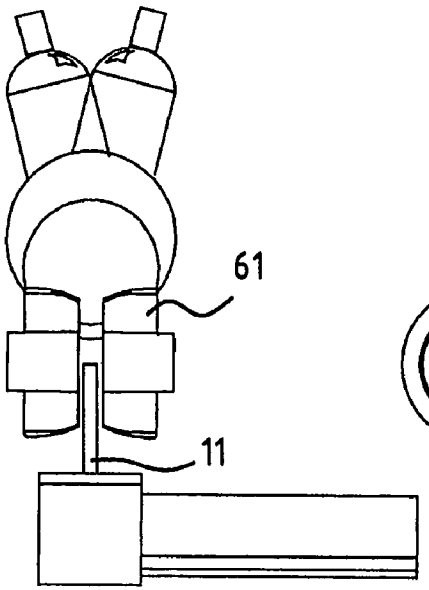
FIG. 7 is a front view of a further embodiment according to the present invention.

FIG. 7 shows that diabolos 61, shown here in front view, consist of two halves between which there lies a space in which the light receiver 11 is movable. The diabolos advance together with the fruits in the direction of arrow B.

Figure 8:
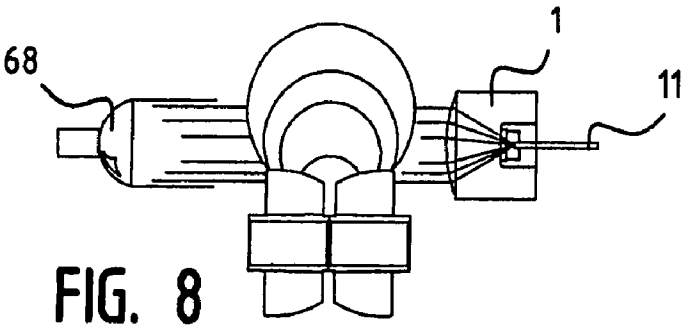
FIG. 8 is a side view of a further embodiment according to the present invention.

In FIG. 8 is shown a front view of a diabolo, wherein a lamp 68 is placed on the one side and a housing 69 for a light receiver is placed on the other side.

In a further preferred embodiment (FIG. 9) there are provided four conveyors 101,102,103,104. These conveyors have different purposes which will be further described. Conveyor 101 is a diabolo conveyor which serves as singulating means for the fruit in a prior art fruit sorting device. The fruit supplied in the direction of movement of arrow C is supplied at the height of the broken lines D-D. The fruit will be transported along this line during all movements in this fruit sorting device. At the end of conveyor 101 the fruit will be picked up between the diabolos at the location of position P by the hands 111 of conveyor 104. Fruit F will be transported by these hands along line D to the cups of conveyor 102. Here the fruit will be set down carefully by the hands into cups 112 at position Q. During the transport by cups 112 the fruit will be measured as specified in the embodiment of FIG. 1. After this measurement the hand 111 will pick up the fruit F again at position R and offload it again into cup 113 of conveyor 103 at position S. This conveyor 103 will finally offload the fruit into a transport channel together with other fruits which can be classified into a group in terms of measured characteristics.

Provided in this embodiment for the light measurement performed in conveyor 102 is an illuminating unit 120. Situated herein is a lamp and a lens system which emits light that illuminates the fruit F via mirror 121. In order to enable a light measurement of high quality over a certain period of time, the mirror can be a flat mirror which is slightly tiltable during the movement of the fruit, or the mirror can be a slightly convex mirror which spreads the light over the full path of the fruit during the measuring time period.

Figure 9:
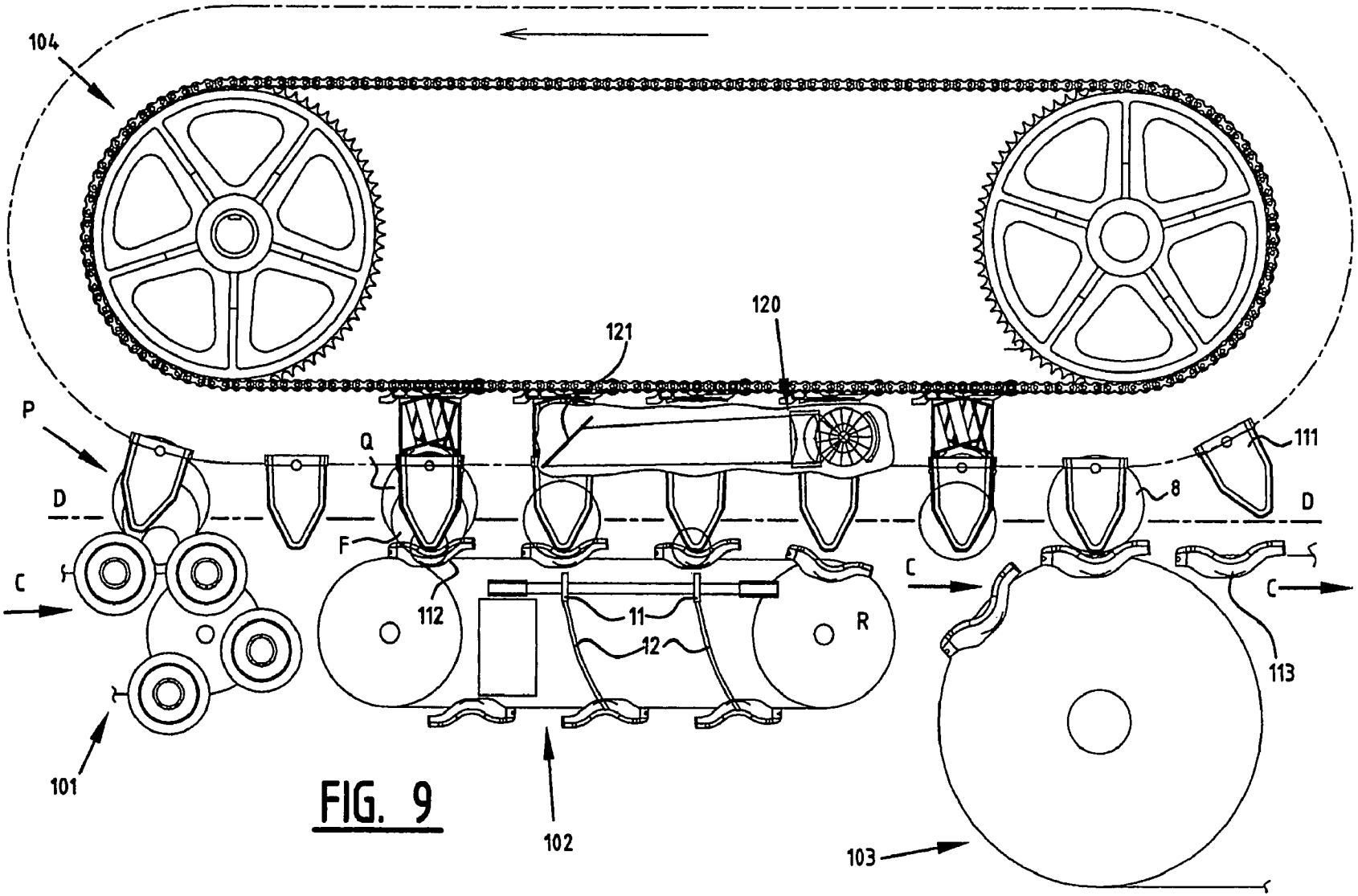
FIG. 9 is a side view of a further embodiment according to the present invention.

An advantage of this embodiment of FIG. 9 is that the conveyor 102 used during the light measurement can be very short, for instance 0.5 to 2 meters. Only a few cups with openings are hereby required to do the light measurement and closed cups 113 can be used for a very long conveyor carrying the fruits to the final destination. If no use is made of a special short conveyor 102, a conveyor will be needed which has the length of conveyor 102 and 103 and which is provided over the whole length with cups with a hole. If it is important that the cups for the light measurement are very clean, a very long conveyor 102 would be very impractical in view of the cost and effort of cleaning. By keeping conveyor 102 very compact, the effort required to clean this conveyor can also be very limited.

Figure 10:
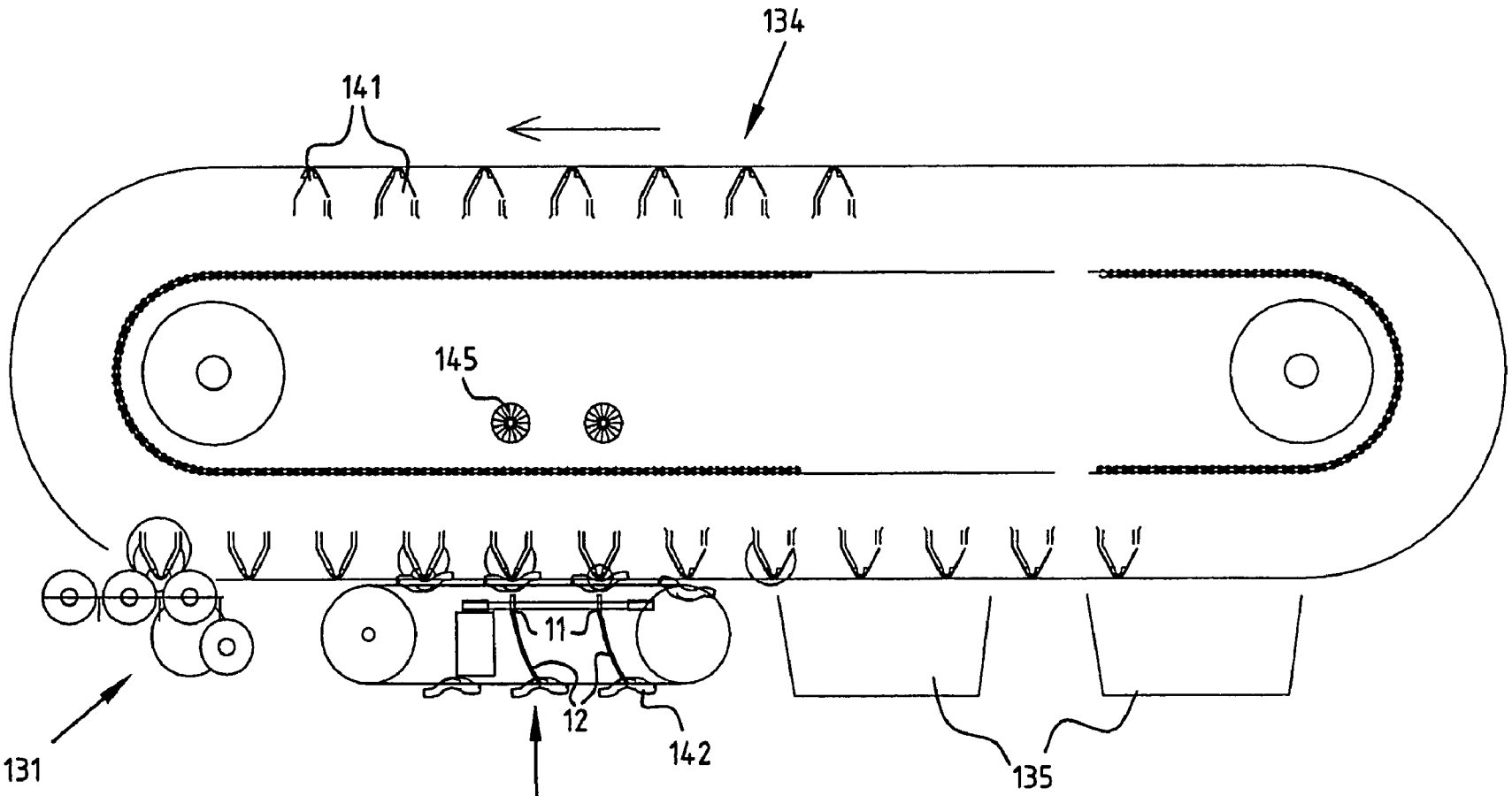
FIG. 10 is a side view in cross-section of an embodiment according to the present invention.

In a further variant of the embodiment of FIG. 9 (FIG. 10) the conveyor 134 provided with hands or grippers for transporting the fruits takes a very long form. Instead of using conveyor 103, which in the embodiment of FIG. 9 transports the fruits to the discharge channels, the transport takes place in this embodiment by means of the grippers. In this embodiment the light measurement takes place in similar manner as in FIG. 9 at the position of a short conveyor 132 which is provided with cups 142 as transport carrier. This embodiment is also provided with a singulating means 131 which singulates the fruits and feeds them to conveyor 134.

Figure 11:
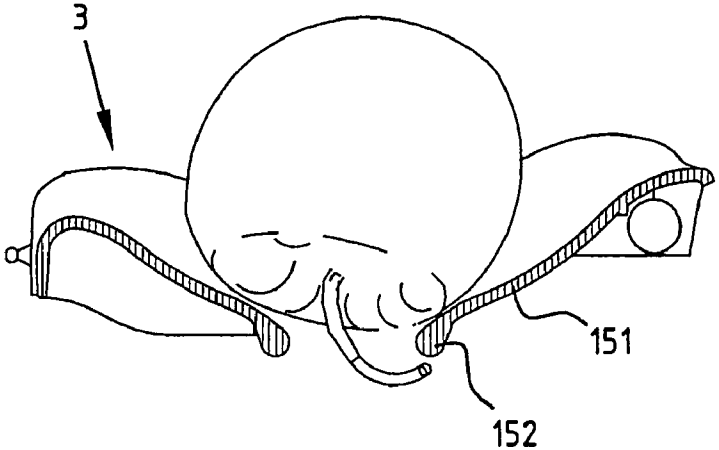
FIG. 11 shows a cross-section of a further embodiment according to the present invention.

As already described above, the cup 3 as fruit carrier is provided with an opening on the underside thereof. The fruit lies in the cup on fruit-carrying part 151. The fruit stalks can protrude on the underside through the opening as shown in FIG. 11. In order to prevent these stalks catching on the edge 152 of the opening as the fruit leaves the cup, the edge takes the form of a droplet as seen in cross-section. Owing to this additional smooth thickening of the material of the opening of the cup, there is no possibility of stalks catching on the edge.

Figure 12:
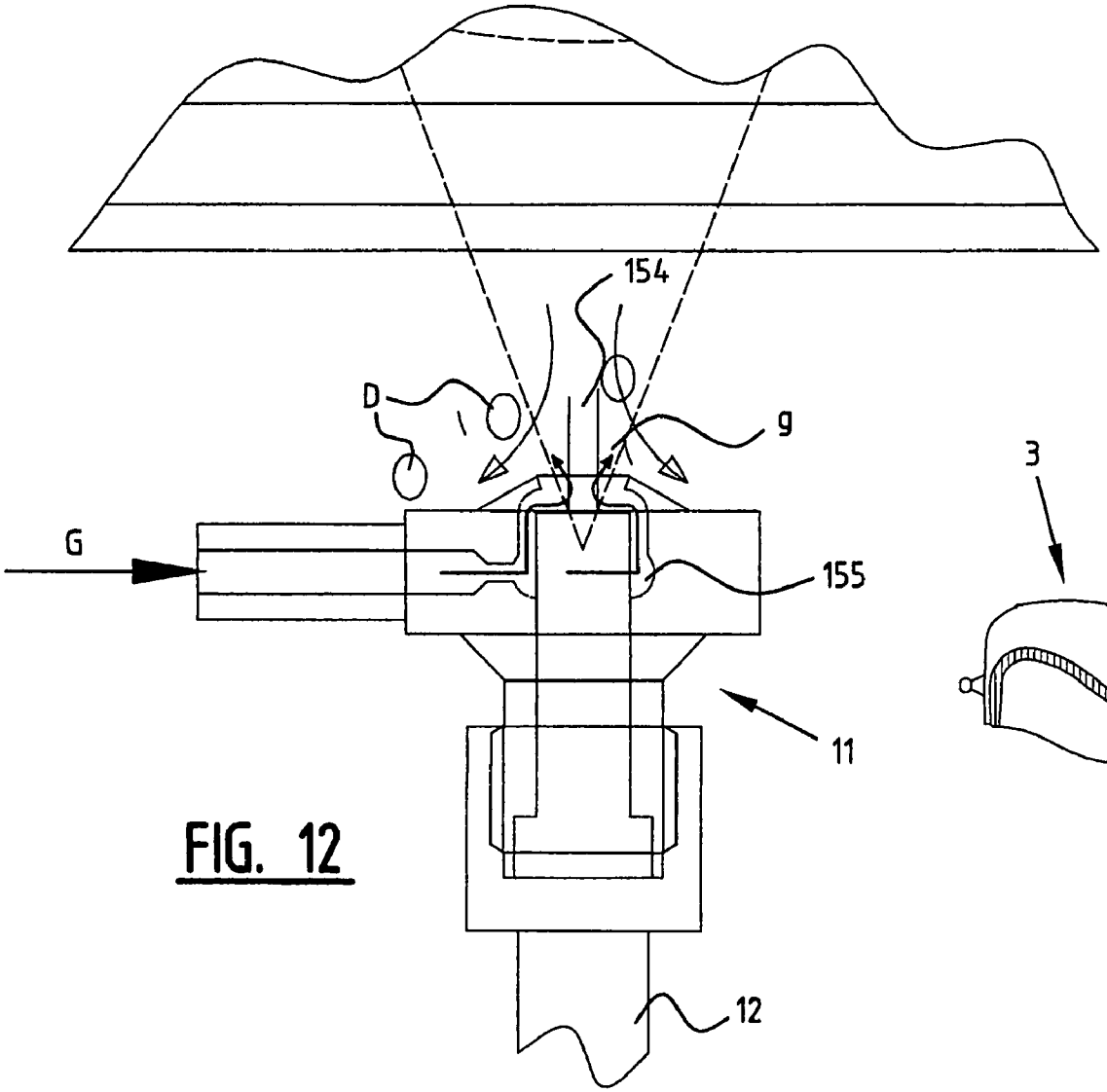
FIG. 12 shows a cross-section of a further embodiment according to the present invention.

A detail of light receiver 11 is shown in FIG. 12. Shown are an opening 154 for admitting light radiated through the fruit. It is disadvantageous for light measurements if the light measuring means can become fouled rapidly. Fouling could be possible because dirt particles D enter the opening 154. In order to prevent this an airflow g is guided along opening 154. For this purpose the light measuring means are provided with an air feed 156 and an air throughfeed 155. An airflow G is supplied through tube 156 to light measuring means 11 and guided through air throughfeed openings 155 in the direction of light aperture 154.

Figures 13, 14A, 14B:
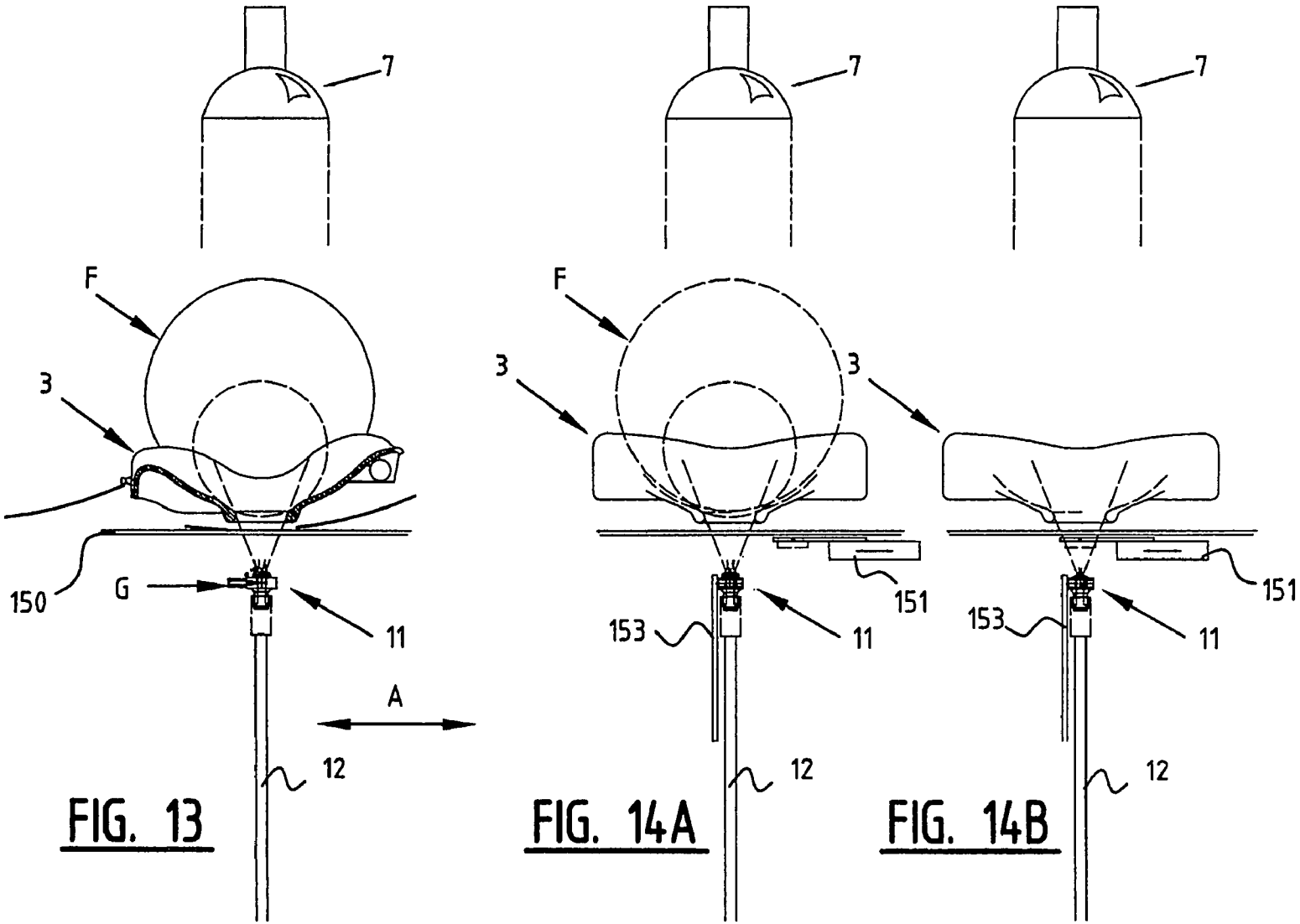
FIG. 13 shows a cross-section of a further embodiment according to the present invention.

FIG. 13 shows a cross-section of a fruit F placed on a cup-like fruit carrier 3 under a lamp 7 which emits light L. Fixed to the fruit carrier is a sheet 156 which is provided with a hole such that this hole is situated under the opening of the following cup of the conveyor (not shown) as described above. In this embodiment the sheet is trained along a sheet guide 150 such that the sheet remains clear of the light measuring means 11.

In respect of the light measurement it is important that the difference is known between the light intensity of the light incident upon the fruit and the light intensity of the light incident upon the light receiver. A calibration measurement is therefore carried out with some regularity, such as for instance every fifteen minutes, without fruit. The spectrum of the illuminating means is measured during such a calibration measurement. This effective spectrum of the illuminating means is hereby always up-to-date irrespective of the possible effects of ageing on these illuminating means.

FIG. 14 shows a cross-section as in FIG. 13, wherein a reference filter 161 is shown under the sheet guide 150. This filter is used during a calibration measurement. The filter slides in front of the receiver a predetermined material transmitting very little light, such as for instance opal glass. The light which passes therethrough is received by the light receiver. There is no fruit in the cup during the calibration measurement (or reference measurement). Such a calibration measurement is important because a light source or radiation source can age, whereby the produced intensity spectrum can change. Radiation sources or lighting sources may also be replaced by other sources, or ambient influences may change such that a calibration measurement becomes necessary. Possible ageing or change of the light receiver can also be neutralized by means of a calibration measurement.

FIG. 15A shows a cross-section of a light measuring device wherein a reflection measurement is performed. In this embodiment diabolos are used to transport the fruits. Cup-like fruit carriers or grippers could also be used in performing such a measurement. In this embodiment the fruits are illuminated by means of lamps 67. By using light receiving means which move reciprocally in the direction of arrow A as in foregoing embodiments, it is possible to carry out a measurement on light reflected by the fruit. The light receiving means 11 moving reciprocally with the fruit enable a light measurement as in a number of embodiments, in this case by means of reflection, by co-displacing with the fruit for a time and thereby achieving a relatively long receiving time. In this case measurement takes place on a part of the fruit located somewhat on the outer side of the fruit.

The embodiment of FIG. 15A is shown in FIG. 15B in top view. Here is shown that a fruit F lies on a fruit carrier formed by diabolo 61. Arrow A also indicates that light receiver 11 is moved reciprocally along the conveyor, whereby it is possible to take measurements on each fruit for a period of time.

The invention claimed is:

1. A system for classifying products being transported by a conveyor having product classification outlets, the system comprising:

a plurality of product carriers for carrying the products in a transport path of the conveyor, wherein each product carrier comprises an underside having an opening;

means for radiating the products during transport of the products by the conveyor; and means for receiving a sample of radiation emitted by the radiating means after having irradiated one or more products, wherein the radiation receiving means moves in a linear direction along the transport path for a period of time and co-displaces with the plurality of product carriers; and wherein radiation emitted by the radiating means gasses through said products and then said opening prior to being received by said radiation receiving means.

2. The system of claim 1, wherein classification of the products is carried out at a speed in the range from about 5 to about 14 products per second.

3. The system of claim 1, wherein the relative movement is reciprocating movement between successive product carriers.

4. The system of claim 1, wherein the radiation receiving means is drivably coupled to a linear motor.

5. The system of claim 1, wherein the radiation receiving means is drivably coupled to a rotation motor.

6. The system of claim 1, wherein the rate of movement of the radiation receiving means is adjustable relative to the speed of the conveyor.

7. The system of claim 1, wherein the radiating means comprises illuminating means positioned adjacent the transport path.

8. The system of claim 1, wherein the radiating means is positioned substantially above the plurality of product carriers.

9. The system of claim 8, wherein the radiation receiving means is positioned substantially under the plurality of product carriers.

10. The system of claim 1, further comprising:

means for measuring the radiation sample received by the radiation receiving means.

11. The system of claim 10, further comprising:

means for conducting the sample radiation received by the radiation receiving means to the radiation measuring means.

12. The system of claim 1, further comprising:

means for analyzing the radiation sample received by the radiation receiving means.

13. The system of claim 1, wherein the emitted radiation has a wavelength in the range from about 300 to about 2500 nanometers.

14. The system of claim 1, wherein the opening comprises a covering of soft material for supporting at least relatively small products.

15. The system of claim 1, wherein a product supporting part of each of the product carriers has a surface curvature for supporting the products wherein relatively small products are supported closer to the edge of the opening and wherein relatively large products are supported further from the edge of the opening.

16. The system of claim 1, wherein each of the product carriers comprises a recess in at least one side thereof for accessing the products.

17. The system of claim 16, each of the product carriers comprises gripper elements which engage product from at least two sides thereof.

18. The system of claim 16, wherein at least one of the gripper elements is configured with an opening for the passage of radiation emitted from the radiating means which radiates and wherein at least one other of the gripper elements is radiation-transmitting.

19. The system of claim 1, wherein each of the product carriers comprises a sheet having a hole therein, the sheet being positioned wherein the hole is situated under a subsequent product carrier in the transport path.

20. The system of claim 1, wherein each of the product carries comprises two diabolo-shaped elements.

21. The system of claim 20, wherein the diabolo-shaped elements each comprise two half-diabolos with an opening therebetween.

22. The system of claim 20, wherein the radiation receiving means is positioned under the transport path.

23. The system of claim 20, wherein the radiation receiving means is positioned adjacent the transport path.

24. The system of claim 1, wherein the radiation receiving means comprises two or more receiving elements for simultaneously receiving radiation samples after having irradiated one or more products carried within two or more product carriers.

25. The system of claim 1, further comprising means for blocking radiation not directed at a product carrier.

26. The system of claim 25, wherein the radiation blocking means comprises at least one adjustable element for varying the width or trajectory of a beam of radiation emitted from the radiating means.

27. The system of claim 26, wherein the at least one adjustable element comprises a reflective material.

28. The system of claim 1, wherein the product is produce.

29. The system of claim 1, wherein the product carriers are the product carriers of claim 28.

* * * * *

UNITED STATES PATENT AND TRADEMARK OFFICE

CERTIFICATE OF CORRECTION

PATENT NO. : 7,622,691 B2
APPLICATION NO. : 10/499582
DATED : November 24, 2009
INVENTOR(S) : Jacob Hendrik De Greef It is certified that error appears in the above-identified patent and that said Letters Patent is hereby corrected as shown below:

In Claim 10 (Originally Claim 44), col. 9, line 7, replace the word "gasses" with the word passes

Signed and Sealed this

Sixteenth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,622,691 B2
APPLICATION NO. : 10/499582
DATED : November 24, 2009
INVENTOR(S) : Jacob Hendrik De Greef It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 933 days.

Signed and Sealed this

Fourteenth Day of December, 2010

David J. Kappos

David J. Kappos
*Director of the United States Patent and Trademark Office*